US010292509B2

(12) United States Patent
Wootten, Jr.

(10) Patent No.: US 10,292,509 B2
(45) Date of Patent: May 21, 2019

(54) UNIVERSAL PILLOW

(71) Applicant: Homtex, Inc., Vinemont, AL (US)

(72) Inventor: Gerald E. Wootten, Jr., Cullman, AL (US)

(73) Assignee: HOMTEX, INC., Vinemont, AL (US)

( * ) Notice: Subject to any disclaimer, the term of this patent is extended or adjusted under 35 U.S.C. 154(b) by 0 days.

(21) Appl. No.: 13/755,895

(22) Filed: Jan. 31, 2013

(65) Prior Publication Data

US 2013/0191998 A1 Aug. 1, 2013

Related U.S. Application Data

(63) Continuation of application No. 61/593,151, filed on Jan. 31, 2012.

(51) Int. Cl.
*A47G 9/10* (2006.01)

(52) U.S. Cl.
CPC ..... *A47G 9/1054* (2013.01); *A47G 9/10* (2013.01); *A47G 2009/1018* (2013.01)

(58) Field of Classification Search
CPC .. A47G 9/10; A47G 2009/003; A47G 9/1045; A61H 2201/1604; A61H 2205/02; A47C 7/38
USPC ..... 5/636, 630, 637, 638, 652, 655.9, 621, 5/622
See application file for complete search history.

(56) References Cited

U.S. PATENT DOCUMENTS 414,748 A * 11/1889 Bentley ..... 5/645
4,731,891 A * 3/1988 Scheurer et al. ..... 5/636
4,777,855 A 10/1988 Cohen
4,876,755 A * 10/1989 Parrish ..... 297/284.3
5,016,303 A 5/1991 Tanaka et al.
5,119,519 A * 6/1992 Foreman ..... 5/640
5,121,515 A 6/1992 Hudson
5,572,757 A * 11/1996 O'Sullivan ..... 5/636
5,948,013 A 9/1999 Swezey et al.
5,953,777 A 9/1999 Buck
5,983,427 A 11/1999 Igei
5,987,676 A 11/1999 Littleford et al.
6,026,330 A 2/2000 Chuang
6,151,733 A 11/2000 Takashima
6,345,401 B1 2/2002 Frydman
(Continued)

FOREIGN PATENT DOCUMENTS

JP 2000253977 A 9/2000
JP 3119790 U 2/2006
(Continued)

OTHER PUBLICATIONS

International Search Report; dated Jun. 21, 2013.

*Primary Examiner* — Eric J Kurilla
(74) *Attorney, Agent, or Firm* — Medley, Behrens & Lewis, LLC; Lorri W. Cooper

(57) ABSTRACT

A universal pillow for seating on a base surface includes a top surface having a negative parabolic shape or a convex shape relative to the base surface and a bottom surface having a convex shape relative to the base surface. The pillow includes up to five zones I-V, with a center zone I being designed for side sleepers, the two adjacent zones II, III being designed for back sleepers, and the two adjacent, outer zones IV, V being designed for stomach sleepers. The pillow may have different sections and parts in order to vary the feel of the pillow.

10 Claims, 8 Drawing Sheets

(56) References Cited

U.S. PATENT DOCUMENTS

| | | | | |
|---|---|---|---|---|
| 6,397,415 | B1 * | 6/2002 | Hsieh | 5/644 |
| 6,481,031 | B1 | 11/2002 | Hwang | |
| 6,526,612 | B1 * | 3/2003 | Zarrella | 5/636 |
| D496,205 | S | 9/2004 | Baddour | |
| 6,848,136 | B2 * | 2/2005 | Sonobe | 5/655.9 |
| 6,981,288 | B1 | 1/2006 | Hu | |
| 7,051,389 | B2 | 5/2006 | Wassilefky | |
| 7,089,615 | B1 | 8/2006 | Parimuha | |
| 7,127,759 | B2 | 10/2006 | Koops | |
| 7,213,280 | B2 | 5/2007 | Lavin et al. | |
| 7,216,387 | B2 | 5/2007 | Laxton | |
| 7,254,852 | B2 * | 8/2007 | Martin | 5/636 |
| 7,367,072 | B1 | 5/2008 | Lubin | |
| D577,943 | S | 10/2008 | Larsen | |
| 7,434,281 | B1 * | 10/2008 | Holliday et al. | 5/636 |
| 7,530,127 | B2 | 5/2009 | Leifermann et al. | |
| 7,735,169 | B2 | 6/2010 | Wassilefsky | |
| 7,856,686 | B2 | 12/2010 | Cho | |
| 7,874,033 | B2 | 1/2011 | Palmer et al. | |
| D634,960 | S | 3/2011 | Anson | |
| 8,015,640 | B2 | 9/2011 | Sun | |
| 8,056,168 | B2 | 11/2011 | Asaka et al. | |
| 8,127,382 | B1 | 3/2012 | Plascencia et al. | |
| 8,732,877 | B2 * | 5/2014 | Ramp | 5/632 |
| 2003/0188385 | A1 | 10/2003 | Rathbun | |
| 2004/0107501 | A1 * | 6/2004 | Kancilja et al. | 5/636 |
| 2004/0139549 | A1 | 7/2004 | Mohrekesh et al. | |
| 2007/0245493 | A1 | 10/2007 | Leifermann et al. | |
| 2008/0134438 | A1 | 6/2008 | Park | |
| 2008/0235877 | A1 * | 10/2008 | Murray et al. | 5/640 |
| 2009/0126117 | A1 | 5/2009 | Lazarus | |
| 2011/0078860 | A1 | 4/2011 | Sun | |
| 2011/0145994 | A1 | 6/2011 | Pileggi | |
| 2011/0271964 | A1 | 11/2011 | Zhang | |
| 2011/0309212 | A1 * | 12/2011 | Guerrieri et al. | 248/118 |
| 2012/0054966 | A1 | 3/2012 | Bacon | |

FOREIGN PATENT DOCUMENTS

| | | | |
|---|---|---|---|
| JP | 2006231008 | A | 9/2006 |
| JP | 2007098087 | A | 4/2007 |

* cited by examiner

UNIVERSAL PILLOW

FIELD

The technology described herein relates to a bed pillow that can be used for side sleepers, back sleepers, and stomach sleepers.

BACKGROUND

People spend about one third of their lives sleeping. Restful sleep is important for maintenance of good health. For this reason, people are always trying to find a way to make themselves sleep more comfortably. A suitable height for a pillow is such that the neck, the cervical vertebra and the backbone of the user are aligned with the head when sleeping on the pillow. When the pillow user lies on his back, he needs a different pillow height from what is needed on his side or on his stomach. Some users prefer two different sleep positions, such as their back and their stomach, or their back and their side. Others use all three sleep positions in order to get a restful night's sleep. It is desirable to have a pillow that can accommodate multiple sleep positions.

There are many different types of pillows. There are pillows for infants, for children, and for adults. There are firm pillows, soft pillows, pillows designed specifically for back sleepers or side sleepers, foam pillows, down pillows, fiber pillows, multi-part pillows and many others. While pillows of various designs are currently available or have been proposed, there remains a need for a pillow that is more universal so that it can be used by persons with multiple sleep preferences.

SUMMARY

In accordance with the teachings described herein, an example universal pillow is shown and described.

BRIEF DESCRIPTION OF THE DRAWING FIGURES

DETAILED DESCRIPTION

Figure 1:
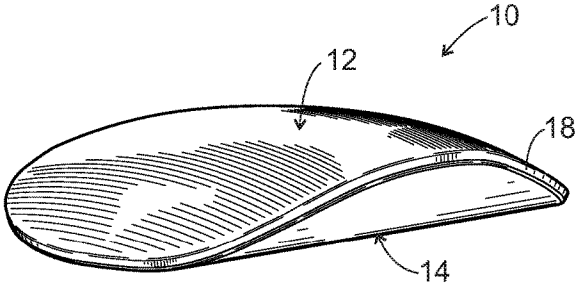
FIG. 1 is a perspective view of an example universal pillow.
Figure 2:
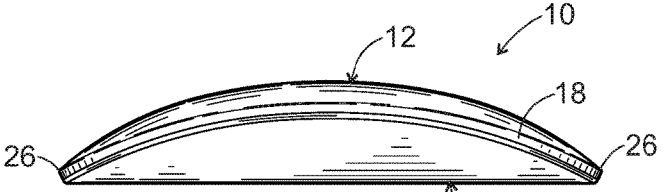
FIG. 2 is a side view thereof.
Figure 3:
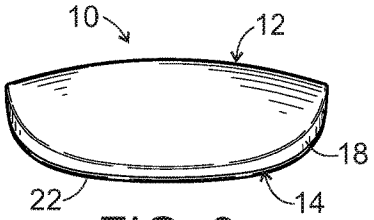
FIG. 3 is an end view thereof.
Figure 4:
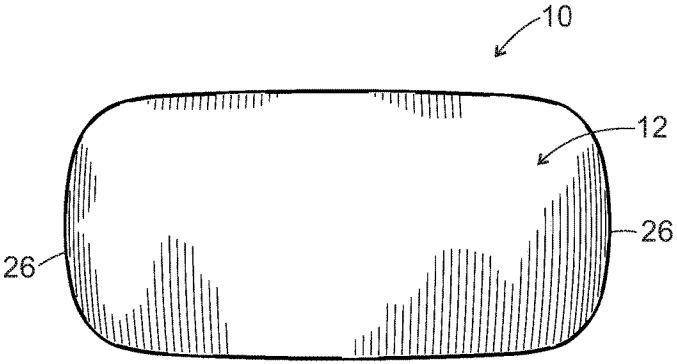
FIG. 4 is a top view thereof.
Figure 5:
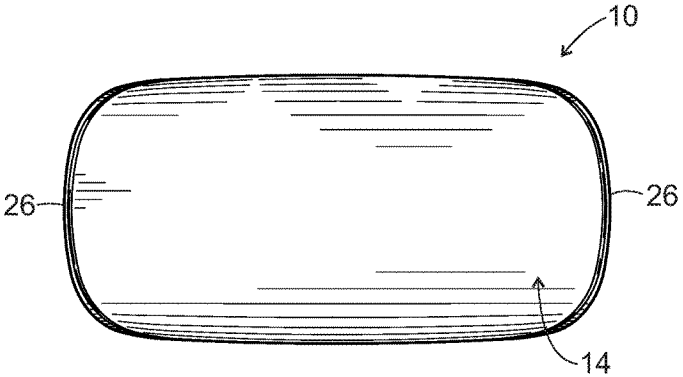
FIG. 5 is a bottom view thereof.
Figure 7:
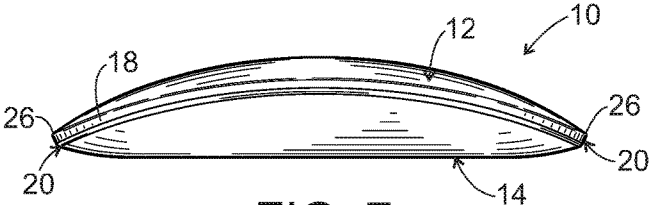
FIG. 7 is a side view of the pillow shown in FIG. 6.
Figure 6:
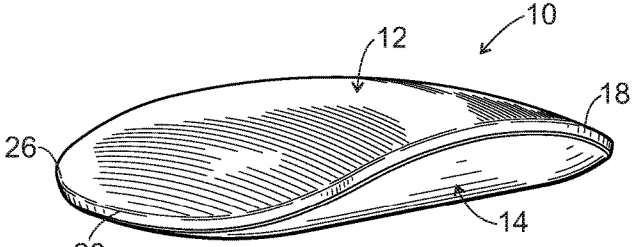
FIG. 6 is a perspective view of an alternative example universal pillow.
Figure 8:
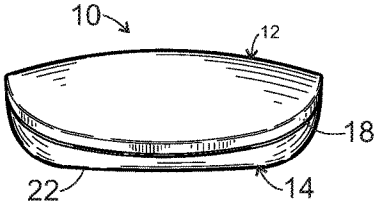
FIG. 8 is an end view of the pillow shown in FIG. 6.
Figure 10:
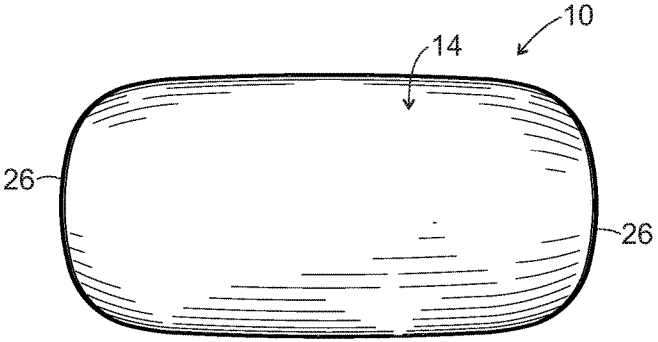
FIG. 10 is a bottom view of the pillow shown in FIG. 6.
Figure 9:
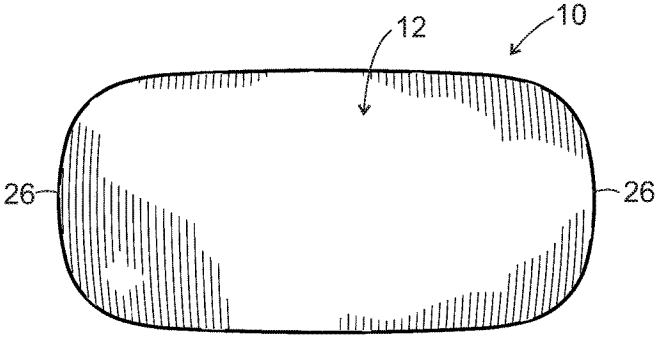
FIG. 9 is a top view of the pillow shown in FIG. 6.

The technology described herein relates generally to a universal pillow, or 3-in-1 pillow, that can be used comfortably by three different types of sleepers, namely, a side sleeper, a back sleeper, and a stomach sleeper. Because of the curvature of the upper surface of the pillow, the example universal pillow is also useful for those individuals who have to wear a mask or other apparatus on their face. The example pillow provides a comfortable sleeping position because the mask does not substantially interfere with the surface of the pillow.

As is well known, back sleepers, side sleepers, and stomach sleepers require pillows of different heights to properly support the user's neck and head while sleeping. Side sleepers require an even sleeping surface for proper neck alignment. Back sleepers typically require pillows that suitably support the sleeper's neck while cradling the head.

The example universal pillow has a length, a width, and a thickness. The top surface of the example pillow 10 is curved or arc-shaped in a longitudinal direction, with the peak P of the curve being present in the middle of the pillow P and the base of the curve being at the ends 26 of the pillow 10. The curved top surface preferably slopes from a maximum height that is in the center of the pillow 10. Alternatively, the top center of the pillow 10 could be flattened. The pillow 10 is broken into five sections, as shown in FIGS. 34-37. The center section of the pillow 10, which is the thickest portion of the pillow 10, is referred to as Zone I and is designed for use by a person who is a side sleeper, shown best in FIGS. 34 and 37. The sections to the left and right of the center section are referred to as Zones II and III and are thinner than Zone I of the pillow 10. These sections are designed for use by a back sleeper, as shown best in FIG. 35. The sections at the ends 26 of the pillow 10 are referred to as Zones IV and V and are the thinnest parts of the pillow. These sections are designed for use by stomach sleepers, as shown best in FIG. 36.

As will be discussed in greater detail below, the top surface of the example pillow may take on any number of known shapes, including, but not limited to parabolic. In addition to having a curved upper surface, the bottom surface of the example pillow may also be curved in a direction that is transverse to the length of the pillow. The bottom of the pillow may have a parabolic, elliptical, or other curved shapes, or non-curved shapes, such as rectangular, as will be discussed in greater detail below.

By providing different Zones for sleeping, the example pillow is useful for any combination of sleep patterns. For example, if a user goes to bed on his back, but ends up sleeping on his stomach, the pillow will suit his needs in both positions. If a user typically sleeps in all three positions, the example pillow will provide the appropriate level of support and comfort for all three positions.

Filling material for pillows should be lightweight, resilient and flexible so that it retains its shape and does not become flattened or crushed permanently. It should be soft in order to provide comfort when used for resting the head, but should retain its shape so that the filling does not move to one end or the other of the pillow encasement. Pillows should also be easily cleaned and should not deteriorate rapidly with age.

Filling materials may be cotton, wool, duck or goose down, polyester, a combination of feathers and down, polystyrene beads, Lyocell down, and foam, as well as other known filling materials. Cotton filling provides a firmer, flatter pillow that holds its shape reasonably well. Cotton is cooler and breathes better than other materials. Wool provides a fuller feeling pillow. Wool is durable, maintains warmth, and absorbs moisture away from the surface of the pillow. Down pillows are softest and provide a "light as air" feel. Down filled pillows can be "squished" and reshaped often.

Synthetic materials may include foam, latex and polyester, combinations thereof or other known synthetic materials. In the case of polyester, the filling can be 100% polyester or a polyester/cotton blend. Polyester fibers can be arranged in three-dimensional clusters that help the pillow hold its shape. Synthetic materials have some benefits over natural fibers—they are allergy and odor free and tend to last longer.

Flexible foam materials, such as latex, viscose, polyurethane, and memory foam may be used, as well as polyester fibers and other foams. Foams may be solid or shredded (also referred to herein as fillers). Polyester fiberfill, also known as Dacron, may also be used, if desired, among other known materials. Different materials have different densities and characteristics. Different materials may be mixed with other materials in order to provide a desired feel. For example, fibers can be mixed with foams. To the extent available, the above-described materials may also be provided in organic form, if desired. Natural materials may also be used, as known by those of skill in the art.

Foams may be provided with drilled holes (not shown) in order to provide a desired feel. The size and shape of the holes, and the number, density, and placement of the holes all affect the feel of the material. As such, foam pillows can be made in many different ways.

Different materials within a pillow can be positioned in pouches or liners, or between baffles, as known by those of skill in the art. Materials can be glued together, such as the case with different types of foam. Loose materials are often better suited for positioning inside a liner or between baffles. Slabs of foam may be positioned adjacent one another without being glued together and may also be positioned within liners in order to deter wear.

Bed pillows typically come in three sizes: 20"×26" for standard pillows, 20"×30" for queen size pillows, and 20"×36" for king size pillows. Other size pillows may also derive a benefit from the invention described herein. The example pillow has a height at the center that is greater than the height at the ends of the pillow. Different height pillows may be desired by persons of different stature. For example, a broad-shouldered male may like about a 6" thick pillow while a small female may prefer about a 4" thick pillow. It is envisioned that the example described herein can include inserts, as discussed in greater detail below, in order to provide a variable thickness that is chosen by the user based upon their needs. While not shown in the photos, it is anticipated that the top or bottom surface, if foam, could be convoluted, such as in the form of an egg crate or other surface treatment, as known by those of skill in the art.

A number of different pillow constructions are considered to be within the scope of the invention disclosed herein. Several non-exhaustive examples are discussed below. Variations and other combinations that would be readily understood by one skilled in the art upon reading this disclosure are also encompassed herein.

Examples of Pillow Constructions:

The entire pillow form can be made of solid foam. The foam may be drilled with holes in order to change the density of the pillow, e.g., to make it softer. Different drill patterns may be used to change the density and feel of the pillow to the user. For example, the foam may be solid in the center and drilled on the ends. The foam may be drilled all over, but with different patterns in Zone I versus Zones II-V.

The entire pillow form can be filed with a solid fiber, such as cotton, down, or polyester, for example. Combinations of these materials may be used, if desired.

The pillow form can include layers of fiber and foam. For example, a layer of foam can make up 10% of the form and the remaining 90% can be fiber. The top or bottom layers could be cotton/wool padding, for example.

The pillow form can have a different top layer from the bottom layer or center layer. The top can be fiber and the bottom can be foam. The top can be foam and the bottom can be fiber. The top and bottom can be foam and the center can be fiber. The top and bottom can be fiber and the center can be foam. In all cases where fiber is mentioned, the fiber may be a combination of fiber and foam.

The pillow form can have different layers from left to right. For example, Zone I can include a first fiber material, Zones II and III can include a second fiber material, and Zones IV and V may include a third fiber material. Alternatively, Zone I can have a first foam material, Zones II and III can have a second foam material, and Zones IV and V can have a third foam material. These materials can be separated by baffles or liners, or can be glued to one another, when possible. Zones II and III could have the same materials as Zones IV and V, with Zone I having a different material. Zone I could have the same materials as Zones II and III or Zones IV and IV. Zones II and III could be different from one another. Zones IV and IV could be different from one another. Zones I-V could all be different from one another, if desired.

The fabric on the exterior of the pillow may also be selected to be optimum for the user. For example, one type of fabric may be used on the top and another on the bottom. Different types of fabrics could also be used on the top, if desired. For example, a first fabric could be provided in Zone I, a second fabric could be provided in Zones II and III, and a third fabric could be provided in Zones IV and V. The fabrics in the various Zones could be the same or different, as desired.

The pillow examples shown are generally uniform left to right. However, this is not required. In another example, the pillow can have different characteristics from left to right, if desired. The left side, for example, could have medium size drilled holes and the right side could have more and larger holes so that the left side would be better suited for back sleeping while the right side would be better suited to stomach sleeping.

As discussed in greater detail below, the present invention anticipates the use of inserts to vary the height of the pillow. A zipper compartment or other compartment that is closeable may be provided that allows the user to insert different layers into the interior of the pillow form.

The pillow may be provided with a gusset that extends around the width of the pillow. The gusset may be thin, such as 1 inch or less wide, or thicker, such as greater than 1 inch wide. When the gusset is provided, the ends of the pillow may overhang the bottom of the pillow, as shown in FIGS. 1-5.

The top of the pillow may take on a number of different shapes. The top may be convex in the longitudinal direction. The bottom may be convex in the transverse direction. One shape that may be utilized for the top surface is a negative parabolic shape. In other embodiments, the top surface may be arc-shaped, stepped, or angled from a central substantially flat portion. One shape that may be utilized for the bottom surface is a parabolic shape, a flattened elliptical shape, an arc-shape, or a rectangular shape. In the case of a parabolic top surface, the top surface of the pillow is defined by:

$$y=-a\,x^2+b\,x+c$$

For the top surface of a standard sized pillow having a 4" height at the center, the equation would be as follows:

$$y=-0.024\,x^2+4$$

For the top surface of a queen sized pillow having a 4" height at the center, the equation would be as follows:

$$y=-0.018\,x^2+4$$

For the top surface of a king sized pillow having a 4" height at the center, the equation would be as follows:

$$y=-0.0125\,x^2+4$$

For the top surface of a standard sized pillow having a 6" height at the center, the equation would be as follows:

$$y=-0.035\,x^2+6$$

For the top surface of a queen sized pillow having a 6" height at the center, the equation would be as follows:

$$y=-0.0265\,x^2+6$$

For the top surface of a king sized pillow having a 6" height at the center, the equation would be as follows:

$$y=-0.0185\,x^2+6$$

The bottom surface may be a positive parabola, according to the formula:

$$y=a\,x^2+b\,x+c$$

For the bottom surface of a pillow having a 6" height at the center, the equation would be as follows:

$$y=20=0.06\,x^2+6$$

For the bottom surface of a pillow having a 5" height at the center, the equation would be as follows:

$$y=20=0.05\,x^2+5$$

For the bottom surface of a pillow having a 4" height at the center, the equation would be as follows:

$$y=20=0.04\,x^2+4$$

For the bottom surface of a pillow having a 3" height at the center, the equation would be as follows:

$$y=20=0.03\,x^2+3$$

The bottom surface may be a half-ellipse defined by the equation, for a horizontal axis:

$$x^2/a^2+y^2/b^2=1$$

In the case where adjustment of the pillow is desired, a user may place inserts inside the pillow to raise or lower the height. For example, a thickness of 6-6.5" at the center may be desired by a large-shouldered side sleeper, while a thickness of 4" at the center may be preferred by a side-sleeper with a smaller frame. A single insert may be provided, or multi-tiered inserts may be used to obtain the desired height where the user's spine is properly aligned.

It may be preferred to provide latex foam on the ends of the pillow, such as in Zones IV and V or, in addition, in Zones II and III, for a stomach or back sleeper.

The example pillow works well for a CPAP user who is forced to sleep on their side. The upper curved shape of the example pillow naturally curves downwardly at the sides, so the CPAP mask is not obstructed by the pillow.

Referring to the figures, FIGS. 1-5 represent a first example universal pillow shape or form 10. The example pillow 10 has a convexly curved upper or top surface 12 in the longitudinal direction. The upper surface 12 may be a substantially negative parabolic shape. The lower or bottom surface 14 of the pillow is convex, relative to a base surface 16 that the pillow 10 seats on, in the transverse direction. The bottom surface 14 is arc-shaped. The pillow 10 includes a gusset 18 that extends around the periphery of the pillow 10. The gusset 18 helps to add height around the edges of the pillow 10 and also provides an overhang 20 around the edges of the pillow 10 relative to a base surface 16 that the pillow 10 seats upon. The outer peripheral shape of the pillow 10 is generally rectangular with rounded corners. Other shapes may also be provided, such as oval or rectangular. In addition, the dimensions of the pillow shown may be altered to conform with a standard size, such as standard, queen, or king-size, for a pillow.

In the example shown in FIGS. 1-5, the bottom of the pillow 10 has a substantially flat central portion 22. The center section 24 of the pillow 10 in the longitudinal direction is the thickest portion of the pillow 10. The ends 26 of the pillow 10 are thinner than the center section 24 of the pillow 10.

FIGS. 6-10 depict another example universal pillow shape or form 10. In this example, which is similar in many respects to the example shown in FIGS. 1-5, the example pillow 10 has a convexly curved upper surface 12 in the longitudinal direction and a convex lower surface 14 in the transverse direction, relative to the surface 16 that the pillow 10 seats on. The upper surface 12 may have a substantially negative parabolic shape. In this case, the ends 26 of the pillow 10 along the bottom surface 14 arc upwardly so that they do not rest on the base surface 16 when not in use. This provides for a slightly thinner profile at the ends 26 of the pillow 10 during use. Like the example, shown in FIGS. 1-5, this example utilizes a gusset 18 around the perimeter of the pillow 10. Alternatively, the gusset 18 could be excluded in both examples.

Figure 11:
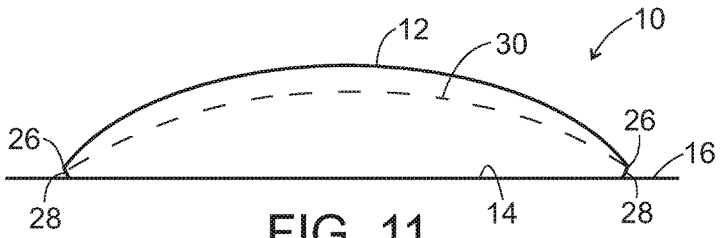
FIG. 11 is a side view of an alternative example universal pillow.

FIG. 11 highlights the exterior of an example pillow 10 that does not utilize a gusset 18, but that has clipped ends 28. The example pillow 10 shows a seam 30 between the top surface 12 and bottom surface 14. The interior of the pillow 10 can be in a single form or in a multi-part form. A single form could be a self-standing foam or a fiber that is seated in a liner (not shown), for example. The multi-part form would have multiple parts that can be joined together in any known manner.

Figure 12:
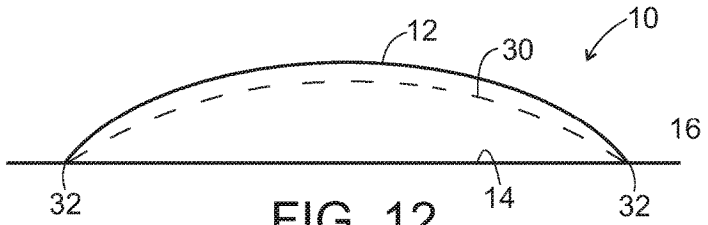
FIG. 12 is a side view of another alternative example universal pillow.
Figure 13:
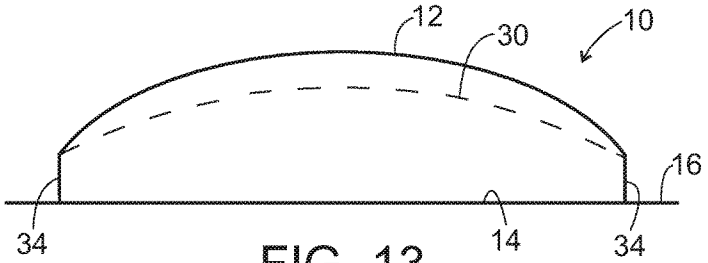
FIG. 13 is a side view of yet another alternative example universal pillow.

FIG. 12 highlights the exterior of an example pillow 10 that does not utilize a gusset 18 and that has ends 32 that extend to the base surface 16 upon which the pillow 10 rests. FIG. 13 highlights the exterior of an example pillow 10 that has a large gusset 34 that extends around the periphery of the pillow 10, with the gusset 34 being perpendicular to the base surface 16. Each of these examples could be in a single form or in a multi-part form, as discussed above in FIG. 11.

Figure 14:
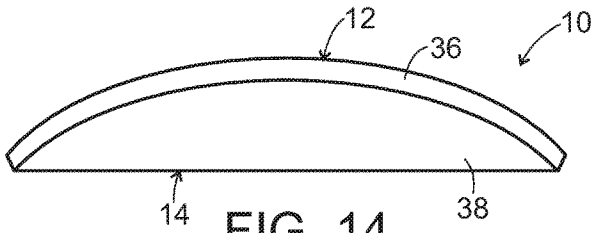
FIG. 14 is a side view of an example universal pillow showing different parts of the pillow.

FIGS. 14-23 highlight different pillow constructions for the interior of the pillow form 10. FIG. 14 shows a two-part pillow 10 having an arc-shaped bottom portion 38 and an upper portion 36 that conforms to the shape of the bottom portion 38. As discussed above, different forms of construction and materials may be utilized for this example. The fill materials could be solid foams or fill. In the case of solid foam, the foams could be glued together or positioned in liners adjacent one another. In the case of fill, the materials could be positioned within liners or baffles. In the case of a combination of foam and fillers, either part could be positioned in a liner or between baffles defined inside the pillow form 10.

Figure 15:
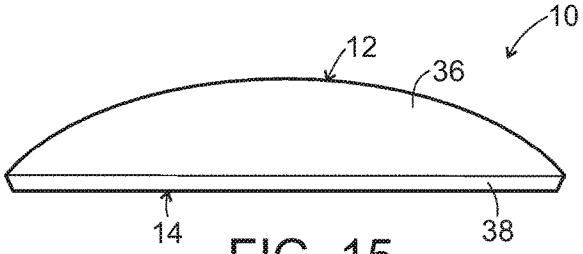
FIG. 15 is a side view of an example universal pillow showing different parts of the pillow.
Figure 16:
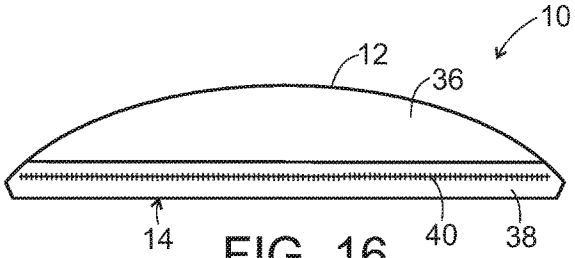
FIG. 16 is a side view of an example universal pillow showing different parts of the pillow as well as a zipper compartment.

FIG. 15 is similar to FIG. 14, but has a thin, flat lower portion 38 and a curved upper portion 36. FIG. 16 has a thicker, flat lower portion 38 and a curved upper portion 36. FIG. 16 shows an example of how a zipper 40 may be applied to the side of the pillow 10 in order to allow a user to enter the interior of the pillow 10. As discussed above, the various parts may be solid foams or fillers, and inserted or joined in any known manner. Inserts (not shown) may be inserted into the pillow 10 via a zipper in order to alter the height or geometry of the pillow 10.

Figure 17:
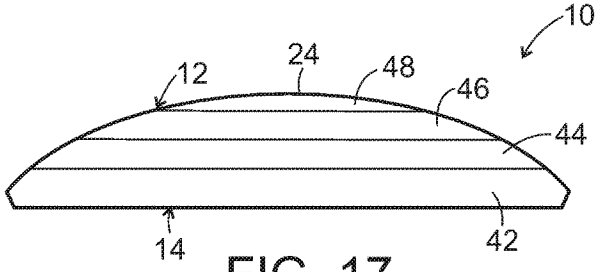
FIG. 17 is a side view of an example universal pillow showing different parts of the pillow.
Figure 18:
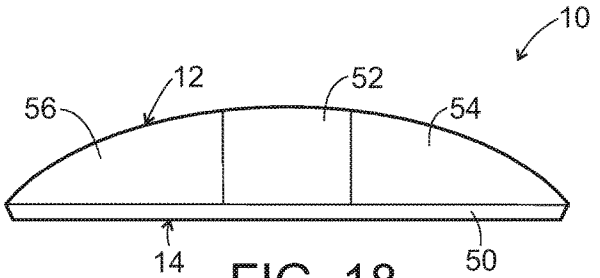
FIG. 18 is a side view of an example universal pillow showing different parts of the pillow.

FIG. 17 shows a multi-tiered construction, with four separate layers 42, 44, 46, 48. In this example, the layers are shown having a particular thickness, but other thicknesses, or number of layers, may be used. The top layer 48, as shown, may cover an expanse of the center portion 24, or Zone I of the pillow 10. FIG. 18 shows a construction with a flat bottom layer 50, a center section 52 and two end sections 54, 56. The center section 52 may encompass all of Zone I while the outer sections 54, 56 may be Zones II-V, although this is not absolutely required. Each section may be a different type of material or some of the Zones may include the same type of material, as desired. As discussed above, the various parts may be solid foams or fillers, and inserted or joined together in any known manner.

Figure 19:
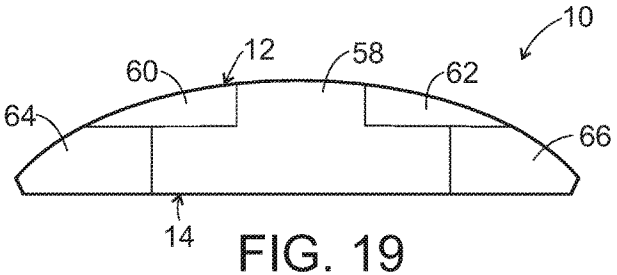
FIG. 19 is a side view of an example universal pillow showing different parts of the pillow.

FIG. 19 shows five separate sections or chambers within the example pillow 10. In this example, a center section 58 covers Zone I at the top of the pillow 10 and a greater expanse of the bottom of the pillow 10, a second section 60 covers Zone II, a third section 62 covers Zone III, a fourth section 64 covers Zone IV, and a fifth section 66 covers Zone V. In this example, the different sections allow customization of the material for each Zone. Zones II and III could be the same material or different from one another, for example. Zones IV and V could be the same material, or different from one another, for example. The material in Zone I could be the same as or different from the materials in Zones II-V, if desired. As discussed above, the various parts may be solid foams or fillers, and inserted or joined together in any known manner. The various parts/sections of this example and other examples could be sold separately so that a user can customize the pillow based upon their individual desires.

Figure 20:
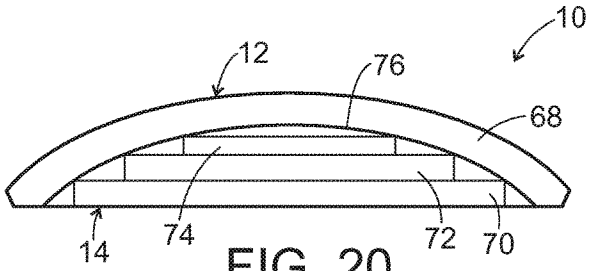
FIG. 20 is a side view of an example universal pillow showing different parts of the pillow.

FIG. 20 shows four separate inserts or chambers within the example pillow 10. In this example, the top layer 68 runs generally parallel to the top surface 12 of the pillow 10 and the bottom three layers 70, 72, 74 are inserts that can be positioned inside the pillow 10 based upon user preferences. More than three or less than three inserts may be utilized. In this example, the exterior of the pillow 10 will have an opening for inserting the pillow forms (not shown) into the interior of the pillow 10 and baffles 76 may be provided between the upper chamber and the lower chamber. The pillow 10 may include a zipper, such as shown in FIG. 16, for allowing the user to enter the interior of the pillow 10 and to close the interior of the pillow. As discussed above, the various parts may be solid foams or fillers, and inserted or joined together in any known manner. Baffles may be provided, if desired.

Figure 21:
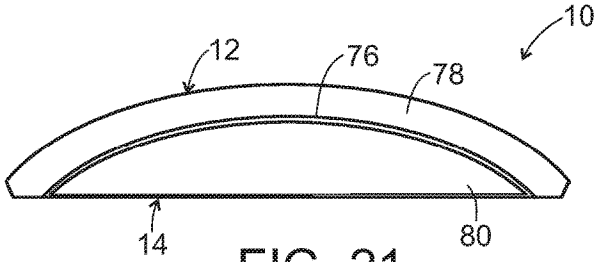
FIG. 21 is a side view of an example universal pillow showing different parts of the pillow.

FIG. 21 shows a two part example pillow 10 that has a top chamber 78 that extends along the length and width of the pillow 10 and runs generally parallel to the top surface 12 of the pillow 10. Alternatively, the top chamber 78 does not have to be parallel to the top surface 12 and could be thicker at different points along the length of the chamber. The pillow 10 has a bottom insert 80 that is arc-shaped on its upper surface to match the bottom surface 14 of the upper chamber. The top and bottom may be integral with one another, such as when both are made of solid foam and glued together. Alternatively, the top may be foam or filler positioned in a liner or behind a baffle 76, and the bottom may be an insert, or filler positioned in a liner behind a baffle. In the case of an insert, a zipper 40 or other means for entering the interior of the pillow 10 may be provided. As discussed above, the various parts may be solid foams or fillers, and inserted or joined together in any known manner.

Figure 22:
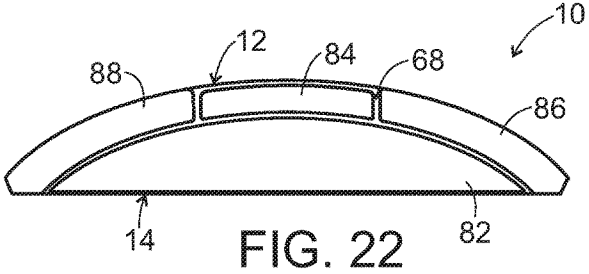
FIG. 22 is a side view of an example universal pillow showing different parts of the pillow.

FIG. 22 shows another example of a multi-part pillow 10 that has a multi-part top chamber 68 that extends along the length and width of the pillow 10 and runs generally parallel to the top surface 12 of the pillow 10. Alternatively, the top chamber 68 does not have to be parallel to the top surface 12 and could be thicker at different points along the length of the chamber. The pillow 10 has a bottom chamber 82 or insert that is arc-shaped on its upper surface. The top chamber 68 of this example pillow 10 has three inserts 84, 86, 88, which may be defined as chambers or as separate inserts positioned in liners or as solid foams. The example includes a center portion 84 and two end portions 86, 88. The center portion 84 generally comprises Zone I while the end portions 86, 88 comprise Zones II and IV and Zones III, and IV, respectively. This example allows the user to have a different firmness or feel for the center section 84 relative to the outer sections 86, 88. In the case of an insert, a zipper 40 or other means for entering the interior of the pillow 10 is provided. As discussed above, the various parts may be solid foams or fillers, and inserted or joined together in any known manner. Alternatively, the end portions 86, 88 could each be separated into separate sections such that different materials or shapes could be used in Zones II, II, IV, and IV, as desired.

Figure 23:
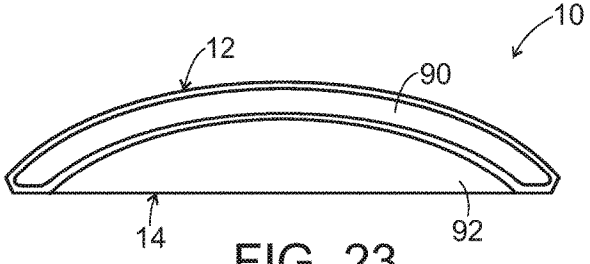
FIG. 23 is a side view of an example universal pillow showing different parts of the pillow.

FIG. 23 shows another example of a multi-part pillow 10, similar to that of FIG. 21. In this example, the top chamber 90 has a thickness such that the bottom surface 14 of the top chamber 90 runs generally parallel to the top surface 12 of the pillow 10. The bottom part 92 of the pillow 10 has an upper arc-shape. The top chamber 90 may be defined by a separate insert that may be inserted by a user and may be chosen based upon the feel or other characteristics of the insert. For example, different inserts could be chosen in winter and summer, with the winter version helping to provide heat to the user and the summer version helping to keep the user cooler. The top chamber 90 may be a different material than the bottom chamber 92. In the case of an insert, a zipper 40 or other means for entering the interior of the pillow 10 is provided. As discussed above, the various parts may be solid foams or fillers, and inserted or joined together in any known manner.

Figure 24:
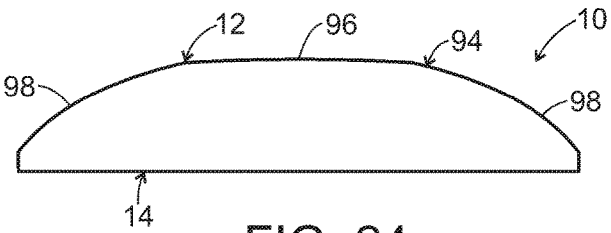
FIG. 24 is a side view of an alternative example universal pillow with a profile that is different from that shown in FIGS. 1 and 6.

FIG. 24 depicts an alternative upper surface 94 for the example pillow 10. In this example, the top 96 of the pillow 10 is substantially flat in the Zone I. Zones II-V 98 slope downwardly to the ends 26 of the pillow 10. The bottom 14 of the pillow 10 in this example would be the same as that shown in FIGS. 2-5, 7-10 or any of the alternative examples shown in FIGS. 29-31

Figure 25:
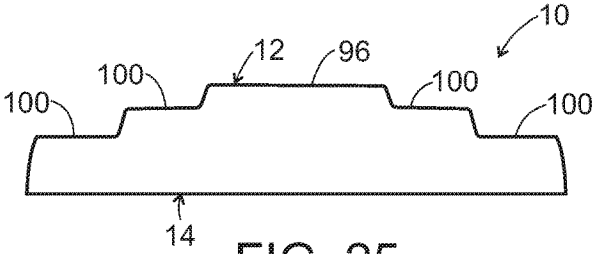
FIG. 25 is a side view of an alternative example universal pillow with a profile that is different from that shown in FIGS. 1 and 6.

FIG. 25 depicts an alternative upper surface for the example pillow 10 where steps 100 are provided between the different Zones of the pillow 10. This embodiment, as with prior examples, could be formed of solid foam or fillers to provide a different feel at each step.

Figure 26:
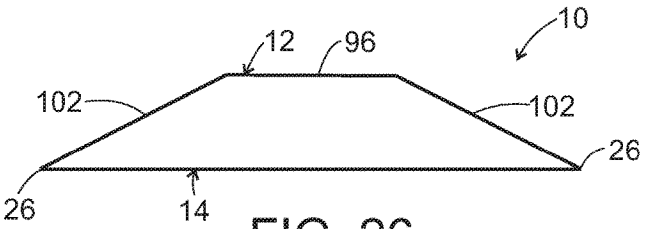
FIG. 26 is a side view of an alternative example universal pillow with a profile that is different from that shown in FIGS. 1 and 6.

FIG. 26 depicts another alternative example, similar to the example shown in FIG. 24, but where part 102 of the upper surface of the pillow 10 in Zones II-V angles downwardly from the flat top surface 96 of Zone I. As shown, the angled part 102 may be angled at a constant angle as it extends between the upper surface 96 and the ends 26 of the pillow. Alternatively, multiple angled surfaces may be joined together between the top surface 96 and the ends 26.

Figure 27:
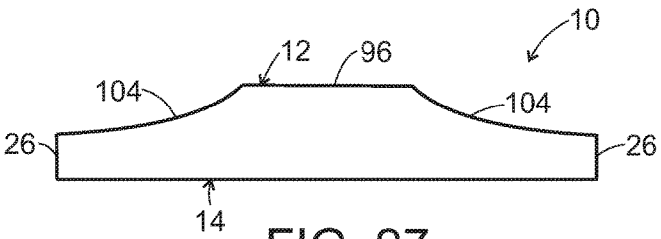
FIG. 27 is a side view of an alternative example universal pillow with a profile that is different from that shown in FIGS. 1 and 6.

FIG. 27 depicts another alternative example, similar to the example shown in FIG. 24, but where part of the top surface 104 slopes downwardly in a negative curved manner from the center surface 96. The ends of the pillow 10 are elevated relative to the base at the ends 26. The elevated ends may be provided by an appropriately placed gusset 18 around the periphery of the pillow.

Figure 28:
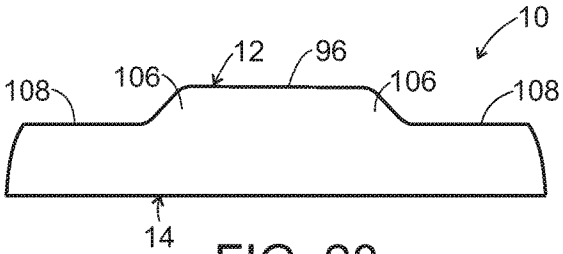
FIG. 28 is a side view of an alternative example universal pillow with a profile that is different from that shown in FIGS. 1 and 6.

FIG. 28 is similar to FIG. 27, but shows a more steep descent 106 from the surface of Zone I relative to Zones II-V. In this example, Zones II-V 108 are on the same plane and are elevated relative to the base surface that the pillow seats on. This elevation could be provided by a gusset 18. The materials of the various Zones of the above-described examples could be varied to provide a different feel or comfort level to a user. As discussed above, the various parts may be solid foams or fillers, and inserted or joined together in any known manner.

Figure 29:
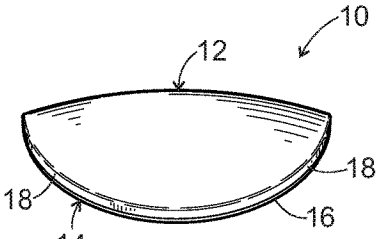
FIG. 29 is an end view of an alternative example universal pillow showing a parabolic bottom surface.
Figure 30:
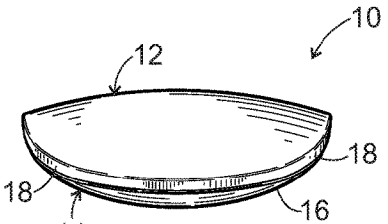
FIG. 30 is an end view of an alternative example universal pillow showing an elliptical bottom surface.
Figure 31:
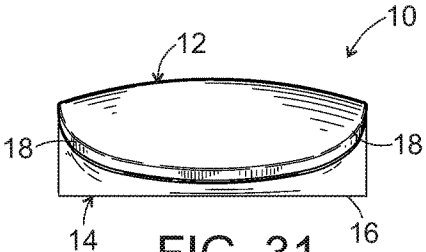
FIG. 31 is an end view of an alternative example universal pillow showing a rectangular bottom surface.

FIGS. 29-31 depict alternative examples of the base surface of the example pillow 10, viewed from the end of the pillow 10. FIG. 29 depicts a parabolic lower surface 14. FIG. 30 depicts an elliptical lower surface 14, and FIG. 31 depicts a rectangular lower surface 14. Alternative base surface profiles may be utilized, as desired. FIGS. 29-31 show the use of a short gusset 18. A gusset 18 is not required, but may be desired in some cases.

Figure 32:
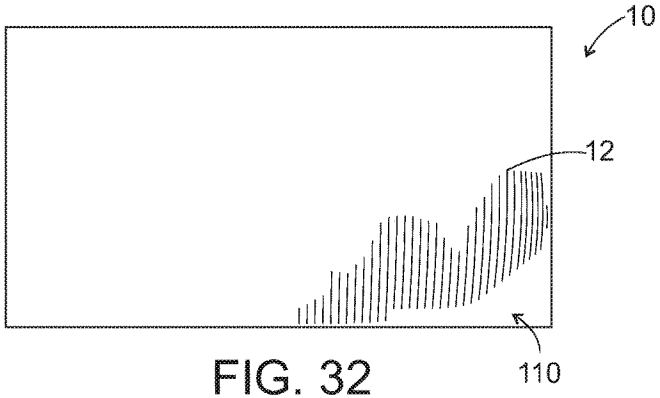
FIG. 32 is a top view of an alternative example universal pillow showing a generally rectangular shape.
Figure 33:
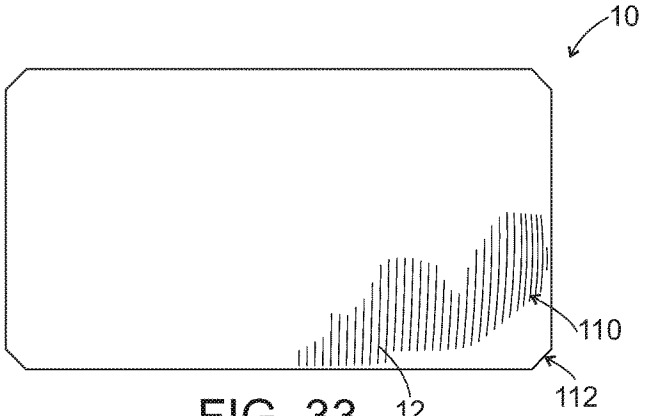
FIG. 33 is a top view of an alternative example universal pillow showing a generally rectangular shape.

FIGS. 32 and 33 show different top surface peripheral shapes for an example pillow 10. FIG. 32 shows a rectangular shape 110 and FIG. 33 shows a generally rectangular shape 110 with clipped corners 112. Other shapes may alternatively be utilized.

Figure 36:
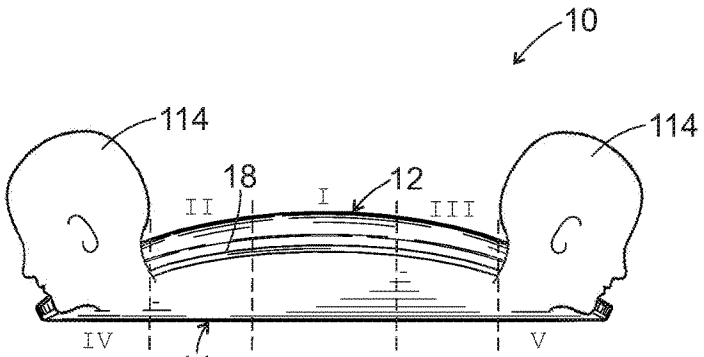
FIG. 36 is a schematic representation showing how a user's head could be positioned on the example universal pillow for a stomach sleeper.
Figure 37:
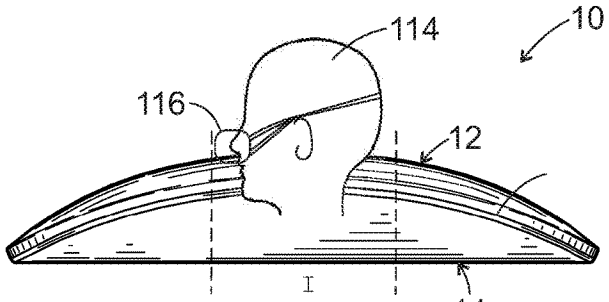
FIG. 37 is a schematic representation showing a how a user, who is wearing a CPAP mask, could be positioned on the example universal pillow in a side sleeper position.
Figure 34:
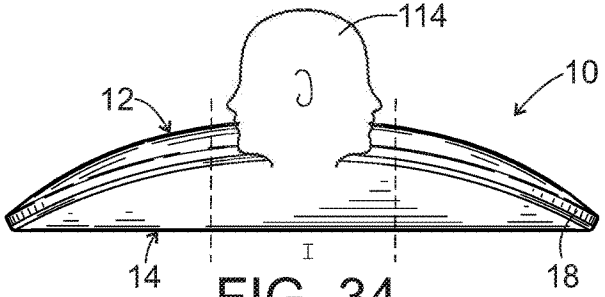
FIG. 34 is a schematic representation showing how a user's head could be positioned on the example universal pillow for a side sleeper.
Figure 35:
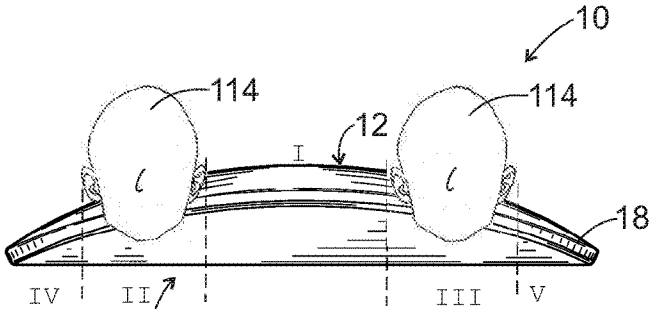
FIG. 35 is a schematic representation showing how a user's head could be positioned on the example universal pillow for a back sleeper.

FIGS. 34-37 show examples of the pillow 10 in use. FIG. 34 shows a user's head 114 positioned in Zone I of the pillow 10 in a side sleeper position. The user's head 114 will dent or compress the pillow 10 in the center to provide a firm support for the user's head 114. In a side sleeper position, the user's nose 115 is typically turned to one side or the other. FIG. 35 shows a user's head 114 positioned in Zones II and III of the pillow 10 in a back sleeper position with the user's nose 115 facing upwardly. As with FIG. 34, the user's head 114 will dent or compress the pillow 10 so that the pillow 10 will hold the user's head 114 in position so that it doesn't roll down the side of the pillow 10. FIG. 36 depicts a user's head 114 positioned in Zones IV and V of the pillow 10 in a stomach sleeper position with the nose turned downwardly and sideways. In this position, the user's head is positioned in the thinnest portion of the pillow. FIG. 37 shows a user's head 114 in Zone I with the user wearing a CPAP mask 116 over their nose 115 and face. Because the pillow 10 angles downwardly from Zone I, the CPAP 116 mask is not obstructed by the pillow 10, regardless of which side the user sleeps on.

Figure 38:
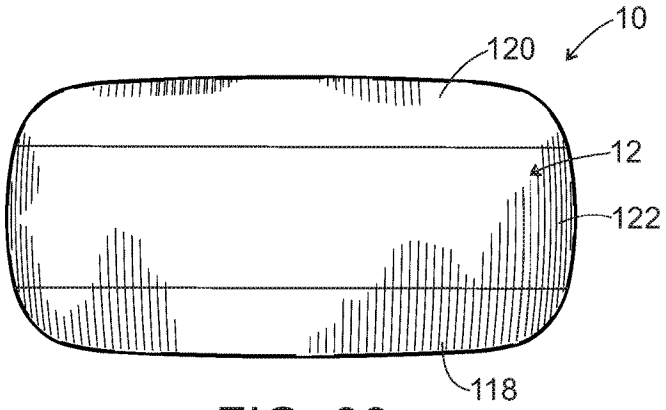
FIG. 38 is a top view of an example universal pillow having separate longitudinal sections of internal or external material.
Figure 39:
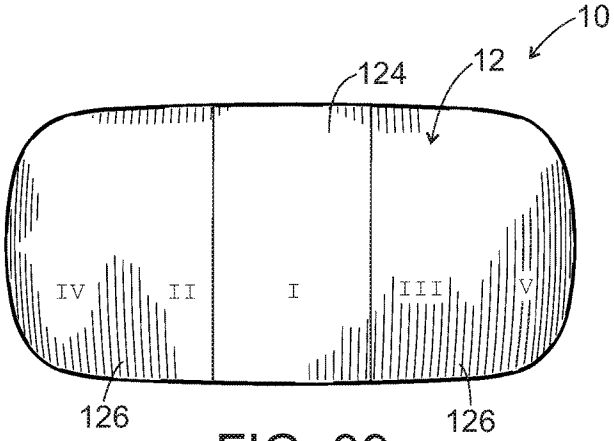
FIG. 39 is a top view of an example universal pillow having separate transverse sections of internal or external material.
Figure 40:
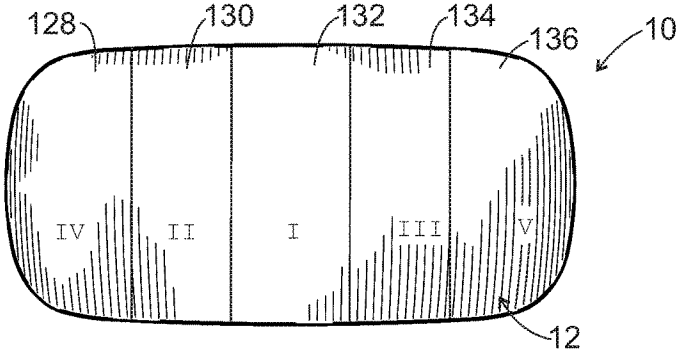
FIG. 40 is a top view of an example universal pillow having separate transverse sections of internal or external material.
Figure 41:
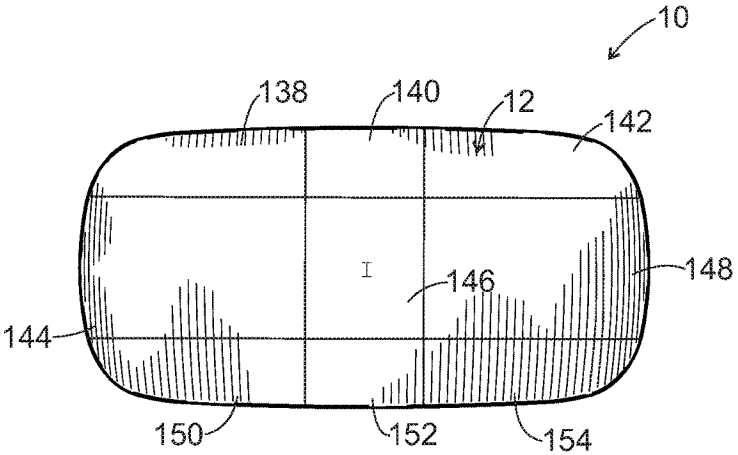
FIG. 41 is a top view of an example universal pillow having separate transverse and longitudinal sections of internal or external material.

FIGS. 38-41 depict alternative examples of the example universal pillow 10 from the top surface 12 of the pillow 10 in order to show how the material of the pillow 10 can vary in the longitudinal direction. FIG. 38 depicts how different materials can be used in the front 118 and rear 120 of the pillow 10 relative to the center 122 of the pillow 10, with the front being the part of the pillow that is adjacent a user's body. FIG. 39 depicts how different materials are used in Zone I 124 relative to Zones II-IV 126. FIG. 40 depicts how different materials 128, 130, 132, 134, 136 can be used in each of Zones I-V. FIG. 41 depicts how materials in sections 138, 140, 142, 144, 146, 148, 150, 152, 154 that extend in both the longitudinal direction and transverse direction can be varied, as desired. As discussed above, the various parts may be solid foams or fillers, and inserted or joined together in any known manner. The embodiments of FIGS. 38-41 can be combined with any of the proceeding examples, as desired.

While the above examples were described with the goal of providing a universal pillow that may be utilized with three different sleep positions, the example pillow could also be designed to be suitable for two of the three sleep positions, such as a pillow designed for both back and side sleepers, for back and stomach sleepers, or for side and stomach sleepers, in which case the geometry would be altered according to the teachings herein to provide the appropriate height/configuration for the pillow, as will be readily apparent to those skilled in the art based upon the teachings herein.

A universal pillow having a length defining a longitudinal direction is for seating on a base surface and includes a top surface and a bottom surface. The top surface has a negative parabolic shape or a convex shape relative to a base surface in the longitudinal direction. The bottom surface is coupled to the top surface.

The bottom surface may have a convex shape relative to the base surface. The shape of the top surface may be defined relative to the longitudinal direction and the shape of the bottom surface may be defined relative to the transverse direction. The bottom surface may have one of a positive parabolic shape, an elliptical shape, a rectangular shape, or an arc-shape. The top surface may have a substantially rectangular periphery or a substantially oval periphery. When the periphery is substantially rectangular, the rectangular periphery has corners that are one of square, clipped, or rounded.

A gusset may be positioned between the top surface and bottom surface. The bottom surface may seat flat against a base surface. The bottom surface may seat with raised ends against a base surface.

In an alternative example, a universal pillow includes a body having a length, a width and a thickness. The body includes a top surface that is divided lengthwise into five Zones. A first Zone is substantially in the center of the top surface and is the thickest portion of the body. The first Zone is for use by a side sleeper. A second and a third Zone are positioned directly adjacent the center portion on either side thereof and have a thickness that is less than that of the first Zone. The second and third Zones are for a back sleeper. A fourth and a fifth Zone are positioned directly adjacent the second and third Zones, respectively, and having a thickness that is less than that of the second and third Zones. The fourth and fifth Zones are designed for a stomach sleeper.

The second and third Zones may have the same height as one another and the fourth and fifth Zones may have the same height as one another. The body may comprise multiple parts, with at least an upper part and a lower part. The upper part may be one of the same material or a different material from the lower part. The upper part may include at least two sections and the at least two sections may be the same or different materials as the other section. The lower part may include one or more sections and the one or more sections may be one of the same material or a different material as the other section. The pillow may have an outer shell and the upper and lower parts may be positioned inside of the outer shell. The lower part may have an upper surface that is one of flat or convex. The lower part may be substantially rectangular. The upper part may be substantially rectangular and of uniform thickness.

The pillow may include means for opening and closing the outer shell for insertion of additional parts into the interior of the outer shell. The means may be a zipper, Velcro, buttons, or some other attachment mechanism.

At least one of the upper parts has a uniform thickness and the lower part has a uniform thickness. The upper parts and lower parts may be separated by a baffle. The upper and lower parts may be adhered to one another. At least one of the upper and lower parts may be positioned inside an insert. The upper part may be divided into multiple parts that are defined in at least one of the longitudinal direction or the transverse direction. The lower part may be divided into multiple parts that are defined in at least one of the longitudinal direction or the transverse direction. The top surface of the body may be convex in the longitudinal direction and the bottom surface of the body may be convex relative to a surface upon which the pillow seats.

In an alternative example, a universal pillow includes a body having a length, a width, a thickness, and a longitudinal axis extending along the length thereof The body includes a top surface and a bottom surface. The top surface has one of a convex shape or a parabolic shape in the longitudinal direction. The body is divided into a top portion and a bottom portion. The top portion is for contact with a user's head and the bottom portion is for seating against a surface.

The top portion may be separate from the bottom portion, with both the top and bottom portions being enclosed together in an outer shell. The top portion may include one or more sections and the bottom portion may include one or more sections. The top portion may be the same material as the bottom portion. The top portion may be a different material than the bottom portion. The top portion may be coupled to the bottom portion by both portions being positioned inside a liner. The top portion may be coupled to the bottom portion by being glued to one another. The top portion may be coupled to the bottom portion by an outer liner having baffles positioned in the interior thereof. Other examples will be evident to those of skill in the art based upon the teachings described herein.

The term "substantially," if used herein, is a term of estimation.

While various features are presented above, it should be understood that the features may be used singly or in any combination thereof. Further, it should be understood that variations and modifications may occur to those skilled in the art to which the claimed examples pertain. The examples described herein are exemplary. The disclosure may enable those skilled in the art to make and use alternative designs having alternative elements that likewise correspond to the elements recited in the claims. The intended scope may thus include other examples that do not differ or that insubstantially differ from the literal language of the claims. The scope of the disclosure is accordingly defined as set forth in the appended claims.

What is claimed is:

1. A pillow having a length and a width, with the length being longer than the width, the length extending in the longitudinal direction and terminating in longitudinal ends, the width extending in the transverse direction, and the longitudinal direction being perpendicular to the transverse direction, the pillow comprising:

a top surface having a convex shape in the longitudinal direction and a convex shape in a transverse direction, with the top surface shape in the longitudinal direction and the top surface shape in the transverse direction together defining a peak on the top surface, with the convex shapes opening downwardly, and with no portion of the top surface being flat, with the top surface having longitudinal ends at the ends of the length of the pillow;

a bottom surface having a convex shape that opens upwardly with the convex shape extending transversely, and with the top surface coupled to the bottom surface; and a filling positioned between the top surface and the bottom surface;

wherein the filling consists of fiber, foam, or a combination thereof.

2. The pillow of claim 1, wherein the pillow consisting of a rectangular shape.

3. The pillow of claim 1, wherein a curvature of the bottom convex surface is larger than a curvature of the top surface in either the longitudinal or transverse direction.

4. The pillow of claim 1, wherein a gusset is positioned between the top and bottom surfaces, and the gusset extends around an entire periphery of the pillow.

5. The pillow of claim 1, wherein the top surface has corners that are one of square, clipped, or rounded.

6. The pillow of claim 1, wherein part of the bottom surface seats flat against a base surface along a portion of its length and the pillow includes ends that are positioned at the ends of the longitudinal top surface, and the ends are raised such that they are not positioned against the base surface, but are substantially adjacent a base surface.

7. The pillow of claim 1, wherein the pillow is divided lengthwise into five sleeping position Zones that include a side sleeper zone, two back sleeper zones, and two stomach sleeper zones, with a first Zone being substantially in the center of the top surface at the peak of the pillow and having a thickness that defines the thickest portion of the body, said first Zone being the side sleeper zone that is designed for a side sleeper, a second and a third Zone being positioned directly adjacent the center portion on either end thereof and having a thickness that is less than that of the first Zone, said second and third zones being the back sleeper zones that are designed for a back sleeper, and fourth and fifth Zones being positioned directly adjacent the second and third Zones, respectively, at respective ends of the pillow, with the ends being positioned at the longitudinal ends of the pillow, and having a thickness that is less than that of the second and third Zones, said fourth and fifth Zones being the stomach sleeper zones that are designed for a stomach sleeper.

8. The pillow of claim 7, wherein the body has a length of at least 26" and a width of about 20" or more; and the body has a maximum thickness of about 3 inches to about 6½ inches.

9. The pillow of claim 7, wherein the second and third Zones are the same height as one another and the fourth and fifth Zones are the same height as one another.

10. The pillow of claim 7, wherein the first Zone has a maximum thickness in the range of about 4 inches to about 6.5 inches, and the ends of the fourth and fifth zones are substantially positioned adjacent a base surface upon which the pillow rests and the ends of the pillow in the fourth and fifth zones are the thinnest parts of the pillow.

* * * * *